US011865401B2

(12) United States Patent
Gardiner, II

(10) Patent No.: US 11,865,401 B2
(45) Date of Patent: Jan. 9, 2024

(54) WEIGHTED BELT SYSTEM FOR A HUMAN BODY

(71) Applicant: Gardiner International Corporation, Silver Spring, MD (US)

(72) Inventor: Reginald J. Gardiner, II, Silver Spring, MD (US)

( * ) Notice: Subject to any disclaimer, the term of this patent is extended or adjusted under 35 U.S.C. 154(b) by 0 days.

(21) Appl. No.: 17/231,151

(22) Filed: Apr. 15, 2021

(65) Prior Publication Data

US 2022/0331647 A1 Oct. 20, 2022

(51) Int. Cl.
*A63B 21/00* (2006.01)
*A63B 21/065* (2006.01)

(52) U.S. Cl.
CPC ..... *A63B 21/4009* (2015.10); *A63B 21/065* (2013.01)

(58) Field of Classification Search
CPC .... A63B 21/4009; A63B 21/065; A63B 19/00
See application file for complete search history.

(56) References Cited

U.S. PATENT DOCUMENTS 1,702,991 A * 2/1929 Bechmann ..... A61H 11/00 601/120
5,531,665 A * 7/1996 Chen ..... A61H 15/00 601/118
6,056,621 A * 5/2000 Lin ..... A63B 19/00 446/236
6,102,769 A * 8/2000 Huang ..... A63B 19/00 446/236
6,379,288 B1 * 4/2002 Liu ..... A63B 21/065 446/236
2015/0364237 A1 12/2015 Mayfield
2019/0290467 A1 9/2019 Chung

FOREIGN PATENT DOCUMENTS

| | | | | |
|---|---|---|---|---|
| CN | 2935863 | | 8/2007 | |
| CN | 108420721 | A | 8/2018 | |
| CN | 209790356 | U | 12/2019 | |
| CN | 210432969 | U | 5/2020 | |
| CN | 111557493 | A | 8/2020 | |
| JP | 3083637 | U | 2/2002 | |
| JP | 3133633 | U | 7/2007 | |
| KR | 200297964 | Y1 | 12/2002 | |
| KR | 200464284 | Y1 * | 12/2012 | ..... A63B 19/00 |

OTHER PUBLICATIONS

Indital, 316 Stainless Steel Sphere 63/64" Dia. Dead Hole, 31/64" Dia., Indital USA, retrieved from https://web.archive.org/web/20130825140943/https://www.indital.com/316-Stainless-Steel-Sphere-63-64-Dia-Dead-Hole-p/e4308.htm (Year: 2013).*

* cited by examiner

*Primary Examiner* — Joshua Lee
(74) *Attorney, Agent, or Firm* — Darrell G. Mottley

(57) ABSTRACT

A weight belt system for a human body including a first free end and an opposed second free end; a plurality of interconnected weighted elements suspended on a wire member between the first free end and the second free end. The weighted elements are disposed adjacent to each other with alternating weighted members; and at least one of the first free end and the free second end being a magnetic weighted member.

13 Claims, 15 Drawing Sheets

WEIGHTED BELT SYSTEM FOR A HUMAN BODY

FIELD OF THE DISCLOSURE

The present disclosure generally relates to a weight belt system and method, more particular to disclosure pertains weighted belt for exercise.

BACKGROUND

The market size of the global fitness and health club industry has been steadily increasing in recent years, exceeding billions of U.S. dollars. According to the United States Center for Disease Control's (CDC) data, approximately two-thirds of all adults in the United States are considered overweight with a Body Mass Index (BMI) value of over 25. Perhaps even more concerning is that approximately 38% of adults the United States are obese, having a BMI value over 30. Obese adults have a dramatically higher risk and incidence of metabolic and cardiovascular diseases (CVD). Weight loss guidelines from organizations such as the American Heart Association, American College of Cardiology, and The Obesity Society, recommend approaches that typically produce modest weight loss, e.g., 5% to 10% of body weight over a 6-month period. Most conventional weight loss programs employ an endpoint of weight reduction or change in BMI. These programs experience only modest success. Visceral fat (VF) is a well-characterized direct marker of cardiovascular and metabolic disease risk in both young and old humans.

SUMMARY

In light of the foregoing background, the following presents a simplified summary of the present disclosure in order to provide a basic understanding of some aspects of the disclosure. This summary is not an extensive overview of the disclosure. It is not intended to identify key or critical elements of the disclosure or to delineate the scope of the disclosure. The following summary merely presents some concepts of the disclosure in a simplified form as a prelude to the more detailed description provided below.

Various aspect of the present disclosure relates to a weight belt system and method being configured for wear to extend around a torso of a human body. A weight belt system for a human body, a first free end and an opposed second free end; a plurality of interconnected weighted elements suspended on a wire member between the first free end and the second free end, the weighted elements are disposed adjacent to each other with alternating weighted members; and at least one of the first free end and the free second end being a magnetic weighted member.

In another aspect, a weight belt system for a human body, a first free end and an opposed second free end; a plurality of interconnected weighted spheres suspended on a wire member between the first free end and the second free end, the weighted spheres are disposed adjacent to each other with alternating weights; and at least one of the first free end and the free second end being a magnetic weighted sphere.

In another aspect, a weight belt system for a human body, a first free end and an opposed second free end; a plurality of interconnected weighted spheres suspended on a wire member between the first free end and the second free end, the weighted spheres are disposed adjacent to each other with alternating weights; and the first free end and the free second end being a magnetic weighted sphere having different magnetic strengths from each other.

In another aspect, a weight system being configured for wear to extend around a torso of a human body includes a plurality of interconnected weighted spheres being suspended on a line member extending between a first free end and a second free end. The weighted spheres are disposed adjacent to each other with alternating weighted elements of a different diameter. The first free end and the free second end each includes a magnetic weighted sphere.

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of 'a', 'an', and 'the' include plural referents unless the context clearly dictates otherwise.

DETAILED DESCRIPTION

In the following description of the various embodiments, reference is made to the accompanying drawings, which form a part hereof, and in which is shown by way of illustration, various embodiments in which the disclosure may be practiced. It is to be understood that other embodiments may be utilized and structural and functional modifications may be made.

"Configured for wear" can contemplate some amount of adjustment or additional configuration such as opening and/or closing fasteners and/or some amount of expansion such as one or more tight-fitting and loose-fitting regions. Accordingly, the configuration of the wearable devices and the manner in which the wearable device is worn by an individual may vary.

Figure 14:
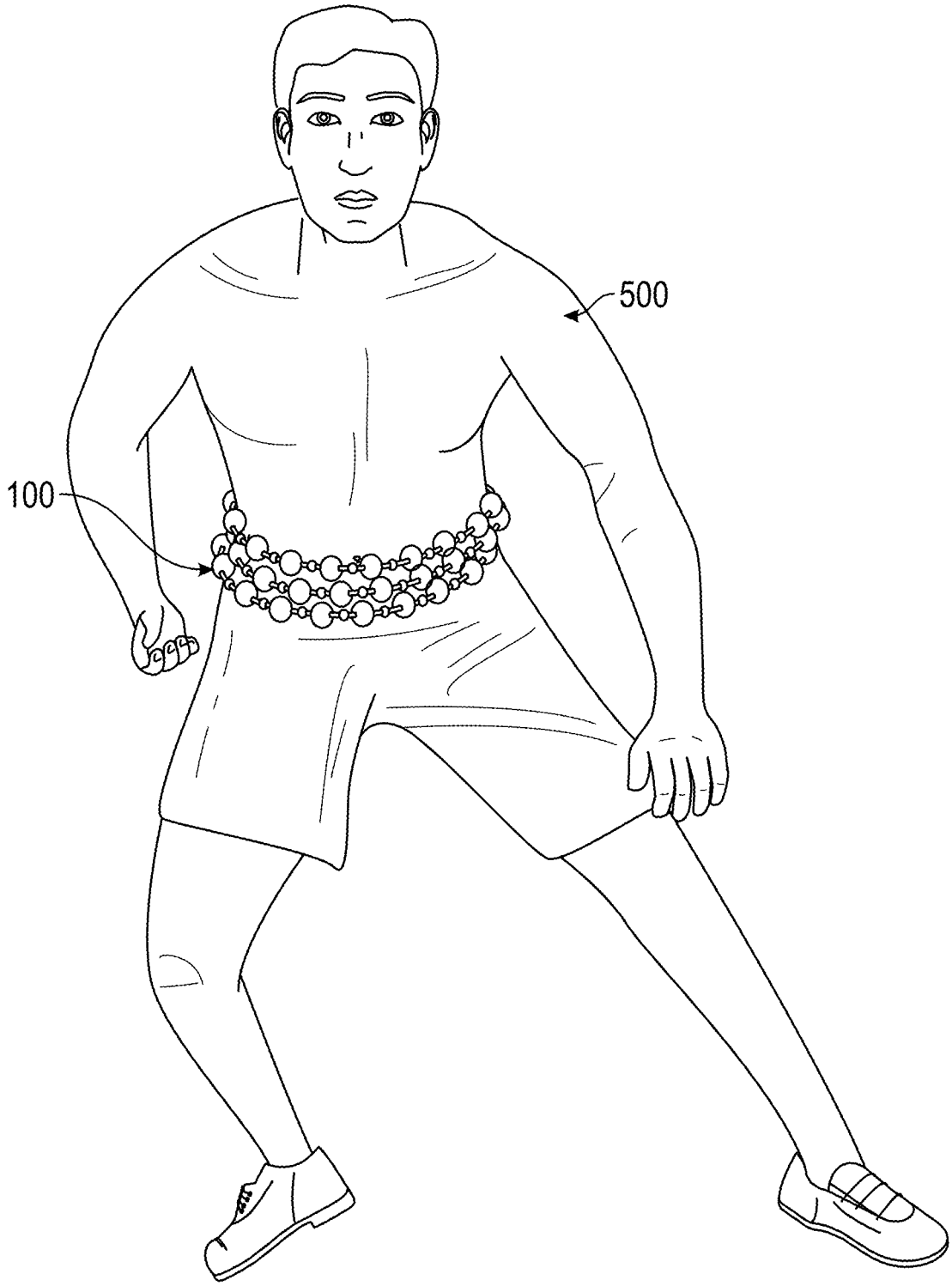
FIG. 14 illustrates a schematic diagram of the weight belt system in-use in which certain aspects of the present disclosure may be implemented.
Figure 15:
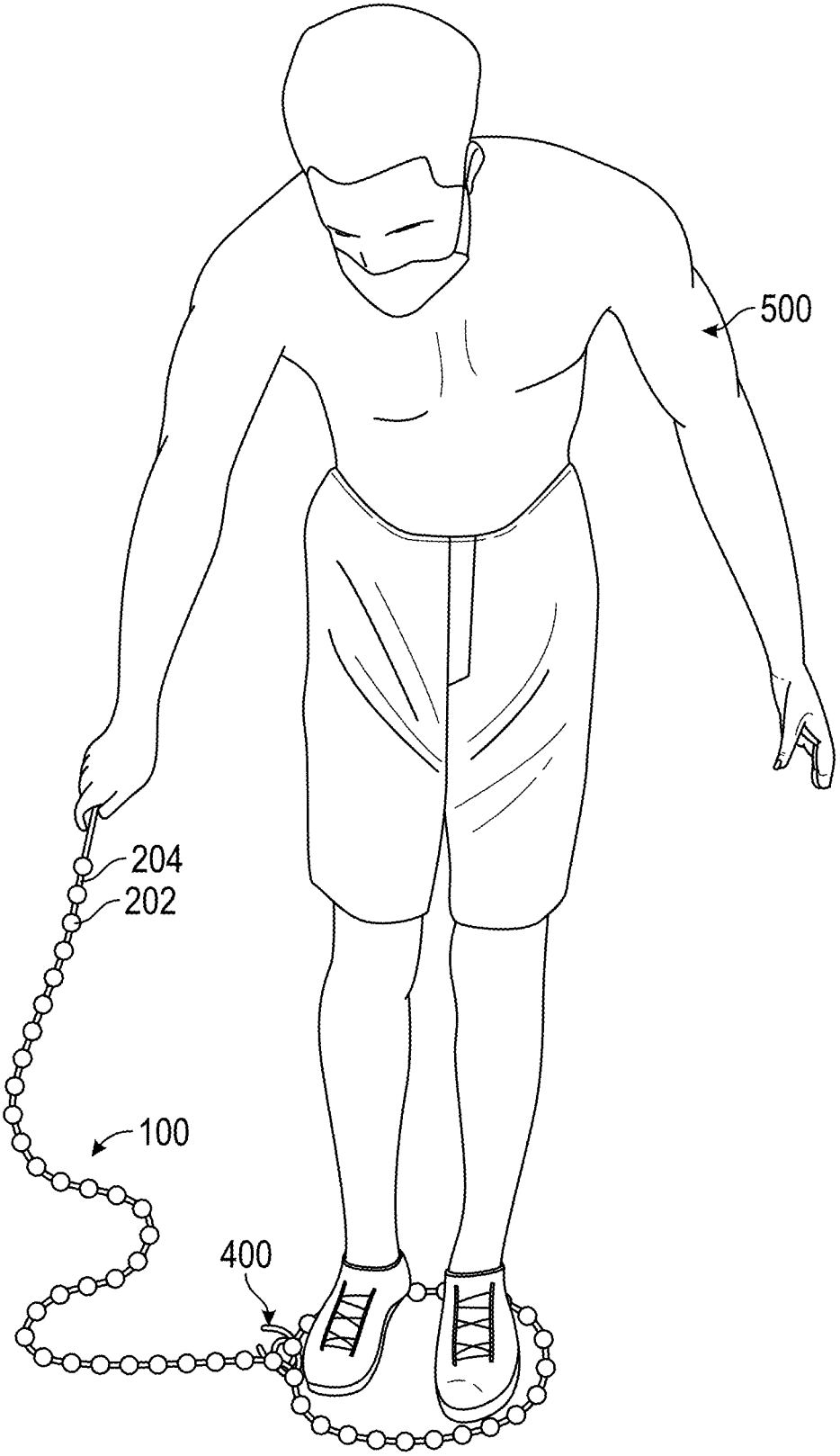
FIG. 15 illustrates a schematic diagram of the weight belt system in-use in which certain aspects of the present disclosure may be implemented.
Figure 16:
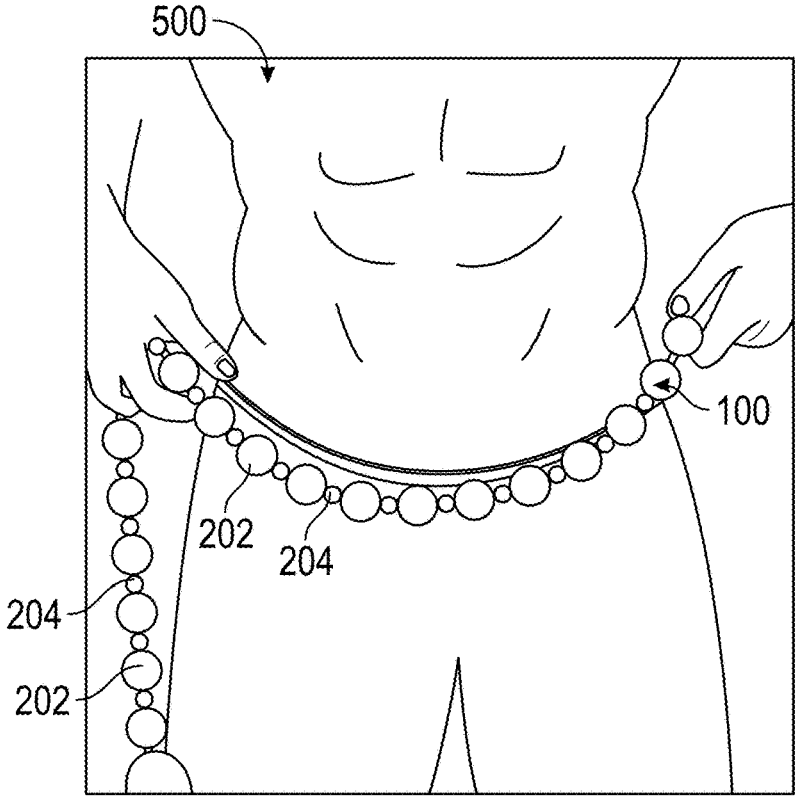
FIG. 16 illustrates an enlarged fragmentary view of the weight belt system in-use in which certain aspects of the present disclosure may be implemented.
Figure 17:
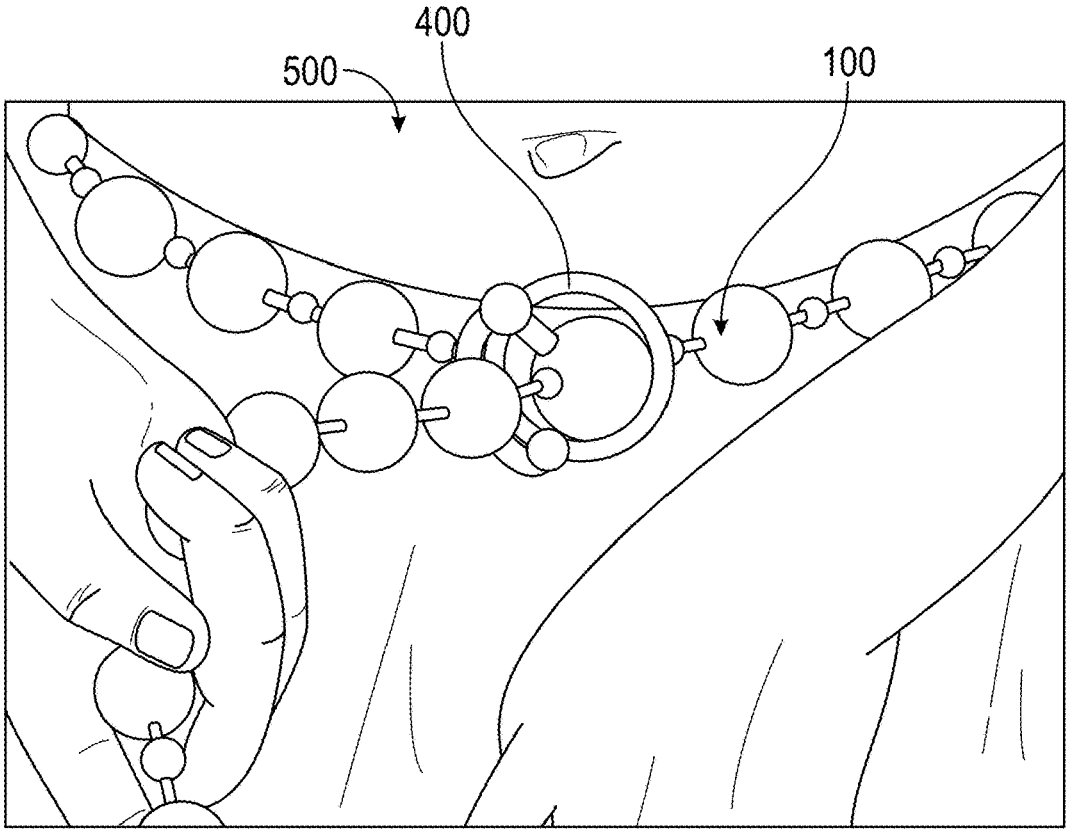
FIG. 17 illustrates an enlarged fragmentary view of the weight belt system in-use in which certain aspects of the present disclosure may be implemented.

As illustrated in the FIGS. 1-20, a weight belt system 100 for a human body provides enhanced locomotion beneficial to overall human health during various activities, such as walking, running, jogging, aerobics, boxing, jumping and other cardio-fitness exercise. During the play of various sports, as well as in the context of various non-athletic activities, a person may rapidly alter motion so as to move in a sideways direction (see FIG. 14). In basketball, football, and various other sports, for example, a player may frequently change direction of movement (or commence moving) by "cutting" quickly to one side. In one aspect, belt system 100 provides a new approach to combat the epidemic of obesity in the United States. In another aspect, the belt system brings a new method of fitness training and enhanced athletic fitness and muscle adaption to the wearer 500.

In one or more constructions, the weight belt system 100 may include a plurality of interconnected weighted members 200 suspended on a wire member 300 between a first distal free end 102 and a second distal free end 104. In one construction, the weighted members 200 may be disposed adjacent to each other with alternating weight member 202 and weight member 204.

Figure 1:
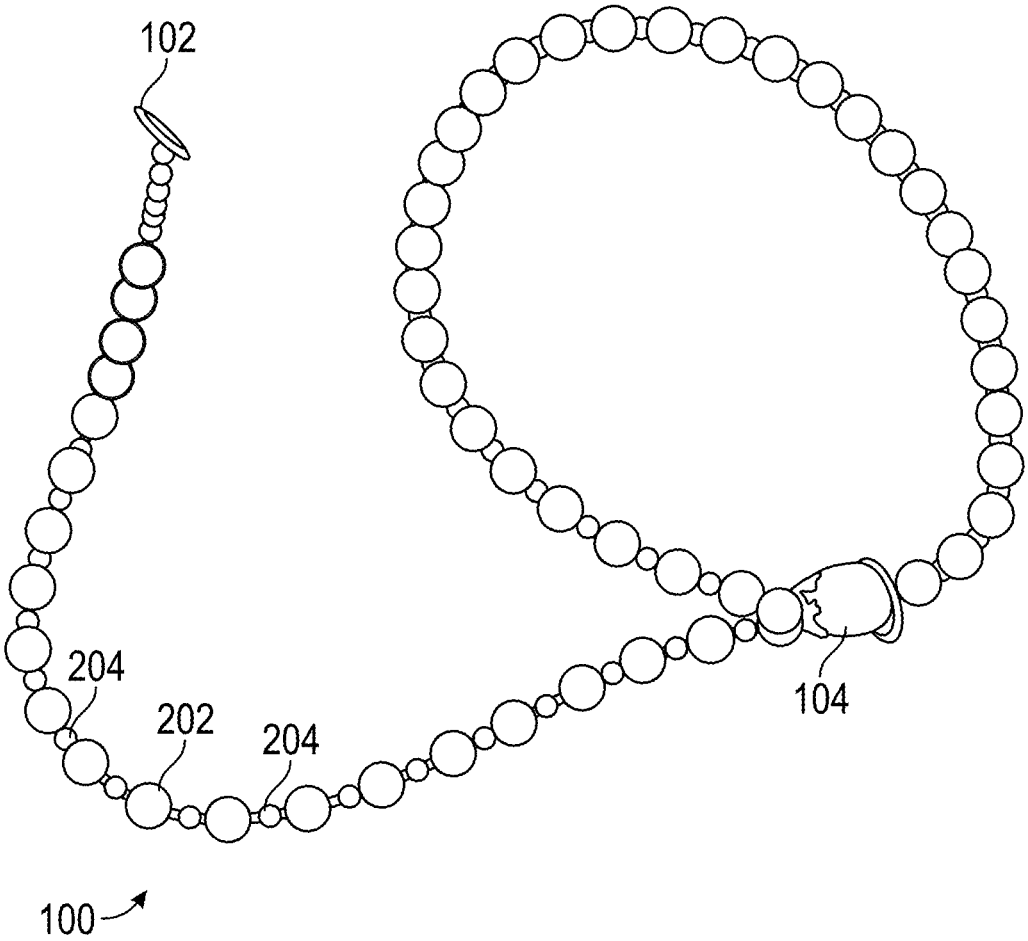
FIG. 1 illustrates a schematic diagram of a weight belt system which certain aspects of the present disclosure may be implemented.
Figure 2:
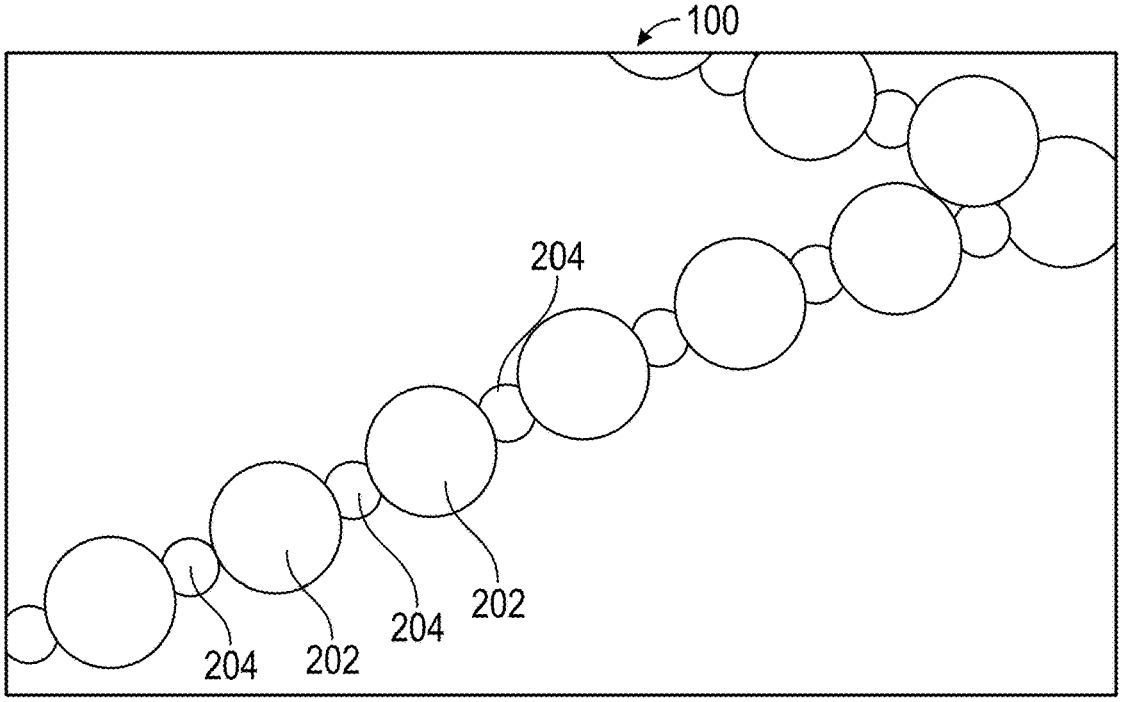
FIG. 2 illustrates an enlarged view of the weight belt system in accordance with one or more constructions and implementations of the present disclosure.

In a more specific construction shown in FIG. 1, the weight belt system 100 may include a plurality of interconnected weighted spheres 200 suspended on a wire member 300 between a first distal free end 102 and a second distal free end 104. In one construction, the weighted spheres 200 may be disposed adjacent to each other with alternating weight sphere 202 and weight sphere 204. In one construction, the first distal free end 102 and the second distal free end 104 may each comprise a magnetic weighted sphere construction 210, 212 to provide fastening or locking functionality to the belt system 100.

Figure 3:
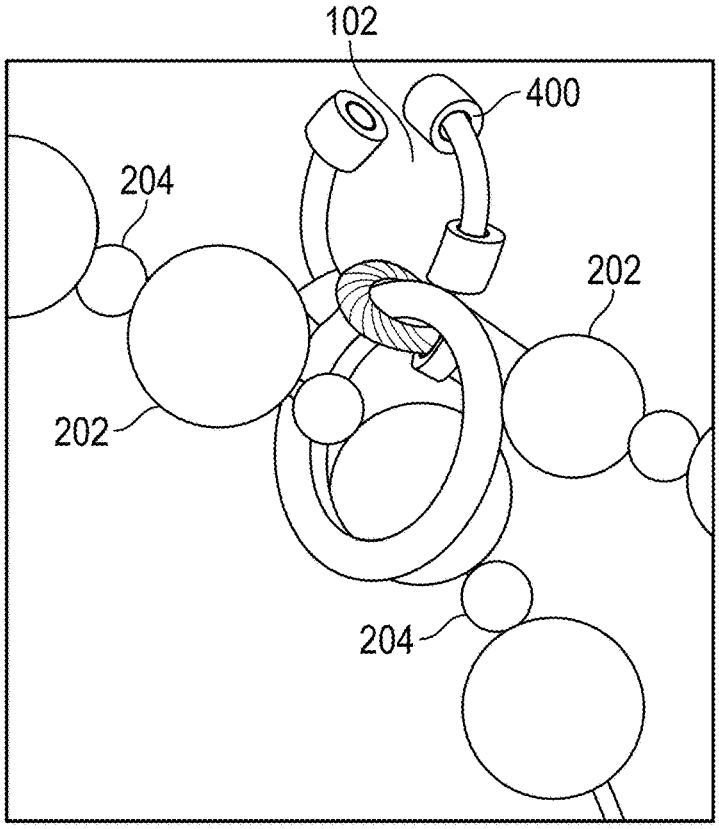
FIG. 3 illustrates an enlarged view of the weight belt system in accordance with one or more constructions and implementations of the present disclosure.

Referring to FIGS. 1-7A-B, 8, and 13-14, the weight belt system 100 may be configured for wear to be worn around a torso of a wearer 500, such as the waist of the wearer 500 (see FIGS. 8 and 13-14) during athletic activity and secured with a magnetic belt fastener system 210, 212. Nevertheless, the belt system 100 may also be configured for wear to be worn around a torso of a wearer 500, such as the across the waist to the shoulder of the user. The fastener system 210, 212 is provided to secure the wearable system 100 around the waist of the wearer 500 with the belt system 100. In one implementation, the tightness of the belt 100 around the waist of the wearer 500 may vary by how it is affixed to the fastener system 210, 212 by way of adjusting a diameter of the belt wrap around the body to comfortably mold around the wearer 500 waist near the center of gravity. Referring to FIG. 3, a clasp lock 400 is provided to lock the belt system 100 to the waist size once belt is wrapped around the torso. The clasp 600 prevents the spheres from moving through the loop freely once engaged.

In one construction, when the wire member 300 is made of a steel line and runs through the magnetic weighted sphere, it has an unexpected effect of magnetizing the steel line 300. This effect causes the steel line to abutting lock to non-magnetized sphere which further causes a good fit of the belt 100 around the torso of the wearer 500. These magnetic spheres keep the belt 100 locked in place as it is wrapped around the waist, while still allowing the belt 100 to comfortably mold around the wearer 500 center of gravity. The wire member 600 can be any number of forms such as cylindrical, flexible strand or single rod of metal. Nevertheless, wire member 600 can be of a high strength plastic material, stranded, non-woven or woven elongated fibers.

Referring to FIG. 1, the spheres 200 can be of a mold configuration, metal casted or machined. In one construction, the spheres 200 can of a steel alloy such as 316 steel. One construction, belt 100 has about fifty 1.25-inch diameter 316 quality steel spheres 200 with a 3/16-inch hole running through the center to receive the wire member 300. In the same construction, the belt 100 may have twenty-five 0.50-inch diameter 316 quality steel sphere 202 with a 3/16-inch hole running through the center to receive the wire member 300. Nevertheless, other constructions of weight members are possible as discussed in the foregoing.

In the same construction, the belt 100 may have two 1.25-inch diameter magnetic spheres 210 with a 3/16-inch hole running through the center and ten 1-inch diameter magnetic 212 with a 3/16-inch hole running through the center to receive the wire member 300. Nevertheless, the size of the spheres and hole size can vary.

In one construction, a first sphere 210 and a second sphere 212 each have different magnetic strengths different from each other. In one implementation, the 1.25-inch magnetic spheres 210 may have a magnetic strength of 50 lbs. of force to release from another sphere 202. In another implementation, the 1-inch magnetic spheres 212 may have a magnetic strength 25 lbs. of force to release. In one construction, a ratio of a magnetic strength of the sphere 210 to the sphere 212 is greater than 1.0. In particular, the ratio of the magnetic strength can be 2.0. Nevertheless, the ratio could range 1.5 to 2.5 in other implementations. In a construction, belt 100 may comprise a one-inch magnetic sphere for every five non-magnetic spheres.

Figure 7A:
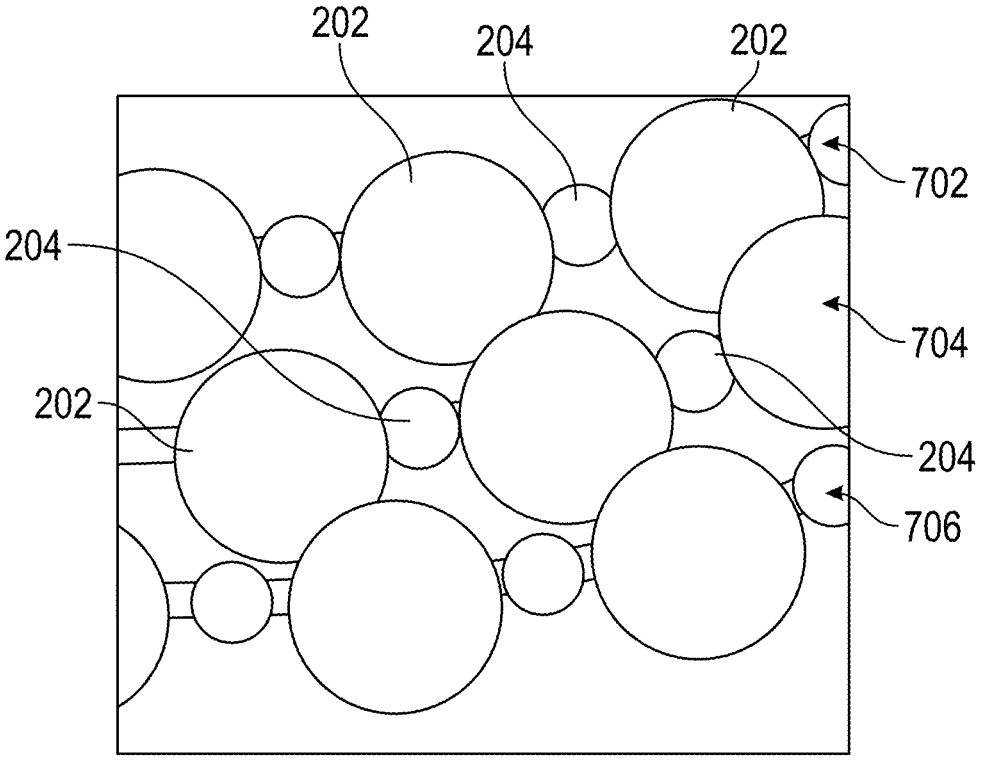
FIG. 7A illustrates an enlarged fragmentary view of the weight belt system in adapted to wrap around a torso of a human body in which certain aspects of the present disclosure may be implemented.
Figure 7B:
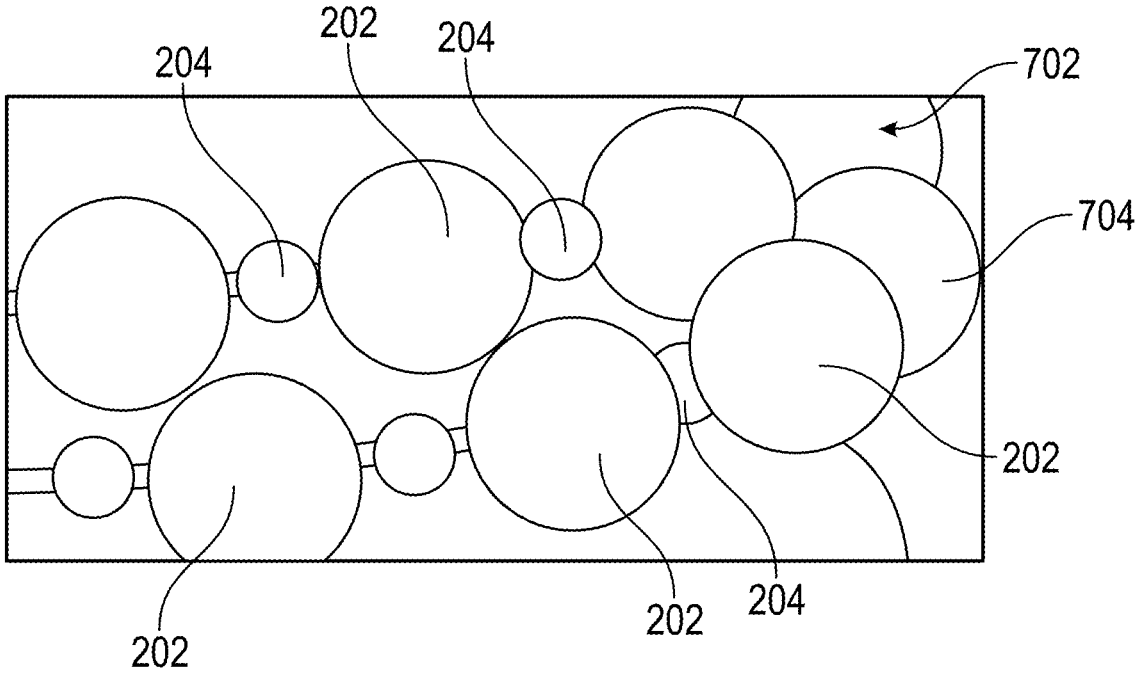
FIG. 7B illustrates an enlarged fragmentary view of the weight belt system in adapted to wrap around a torso of a human body in which certain aspects of the present disclosure may be implemented.
Figure 8:
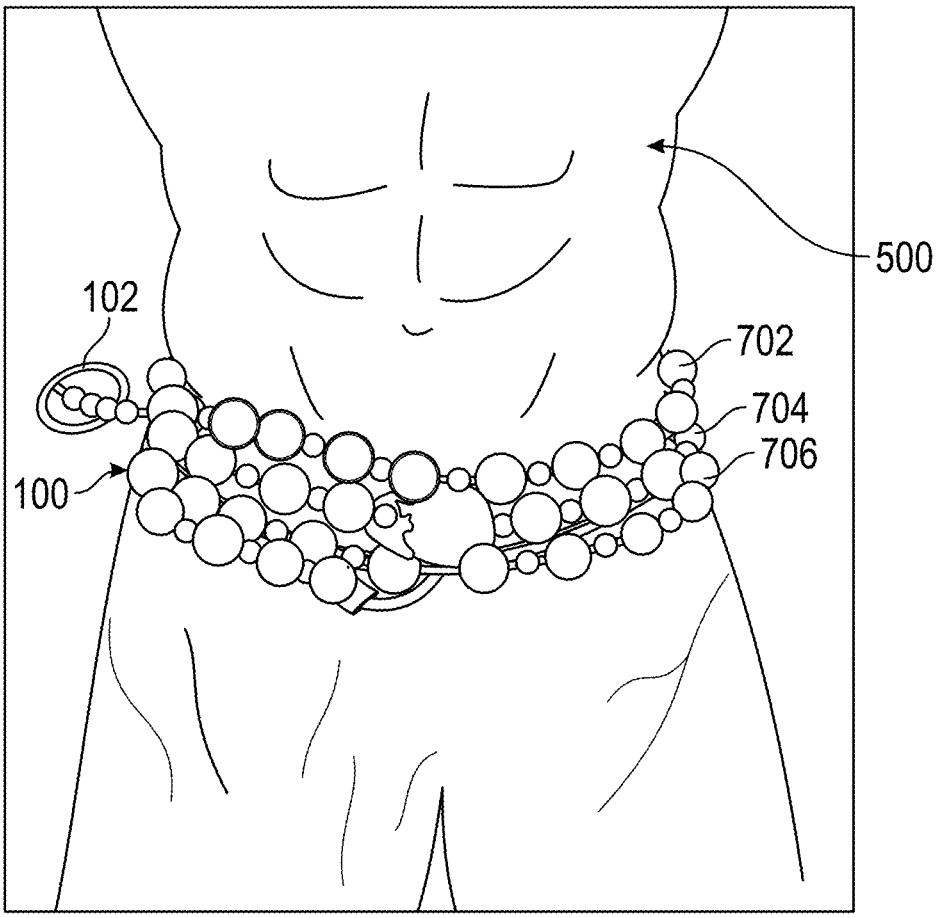
FIG. 8 illustrates a schematic diagram of the weight belt system in which certain aspects of the present disclosure may be implemented.
Figure 9:
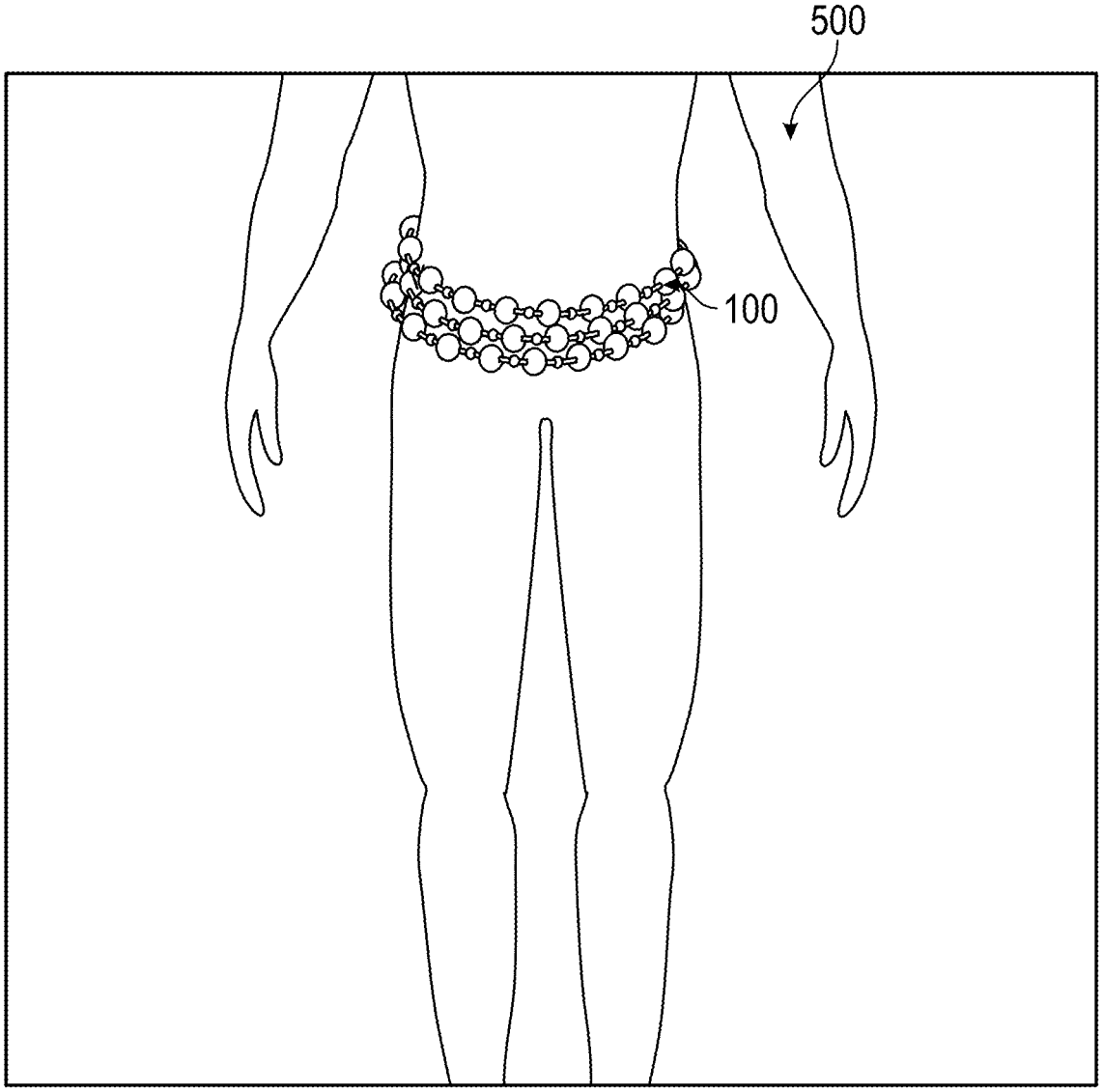
FIG. 9 illustrates a schematic diagram of the belt system anatomical aspects in which certain aspects of the present disclosure may be implemented.
Figure 10:
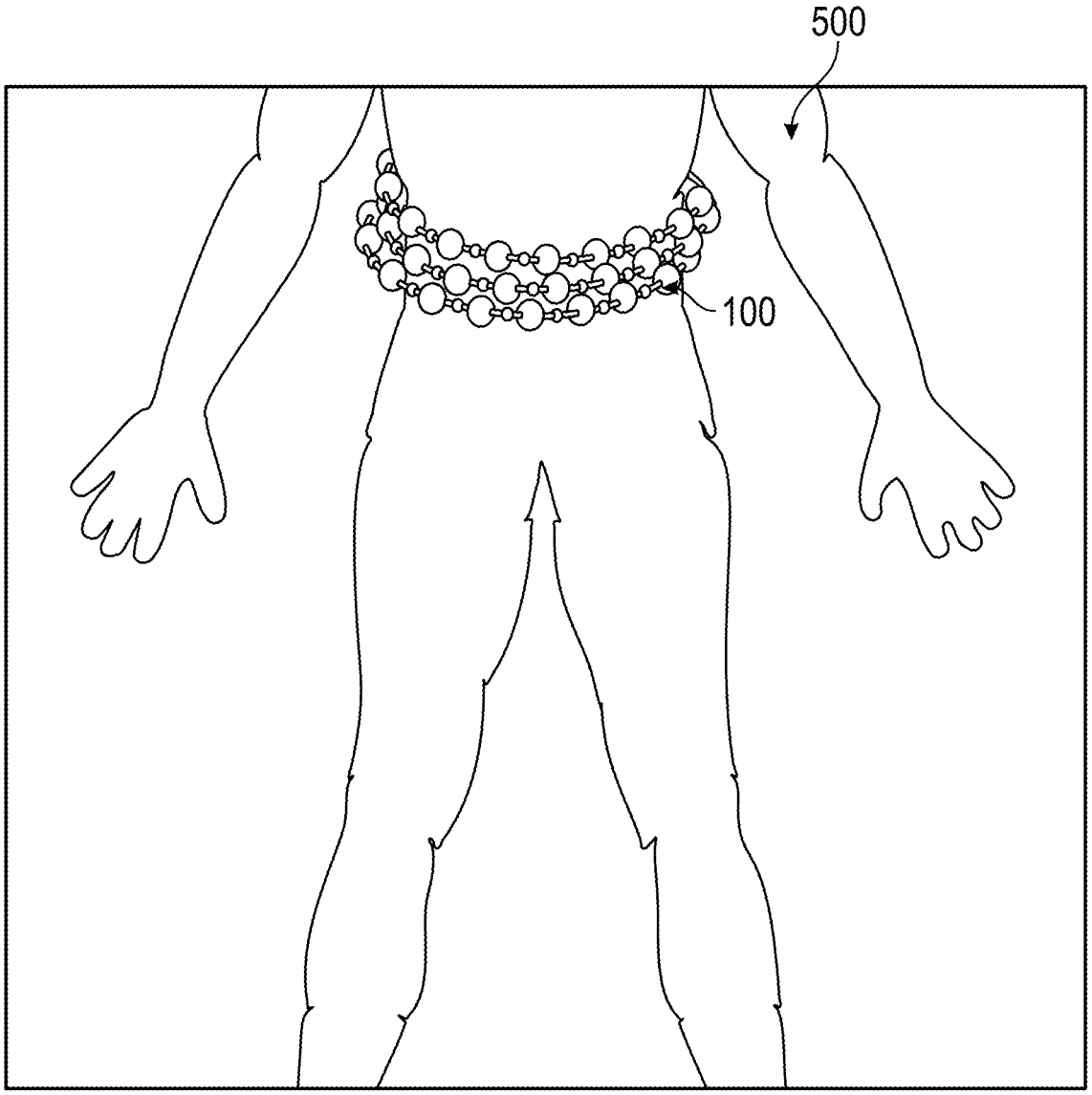
FIG. 10 illustrates a schematic diagram of the belt system anatomical aspect in which certain aspects of the present disclosure may be implemented.
Figure 11:
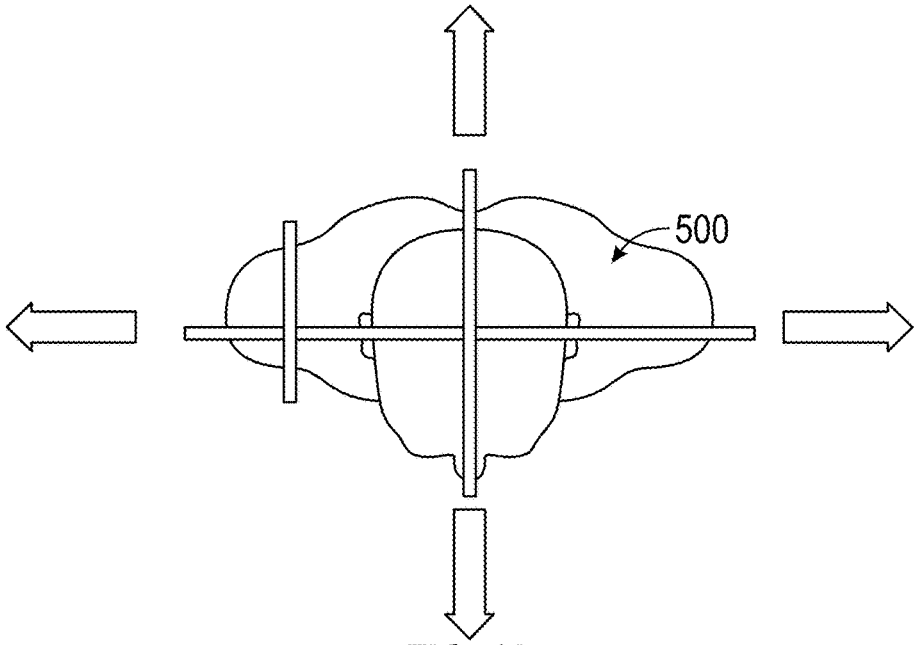
FIG. 11 illustrates a schematic diagram of the belt system anatomical aspect in which certain aspects of the present disclosure may be implemented.
Figure 12:
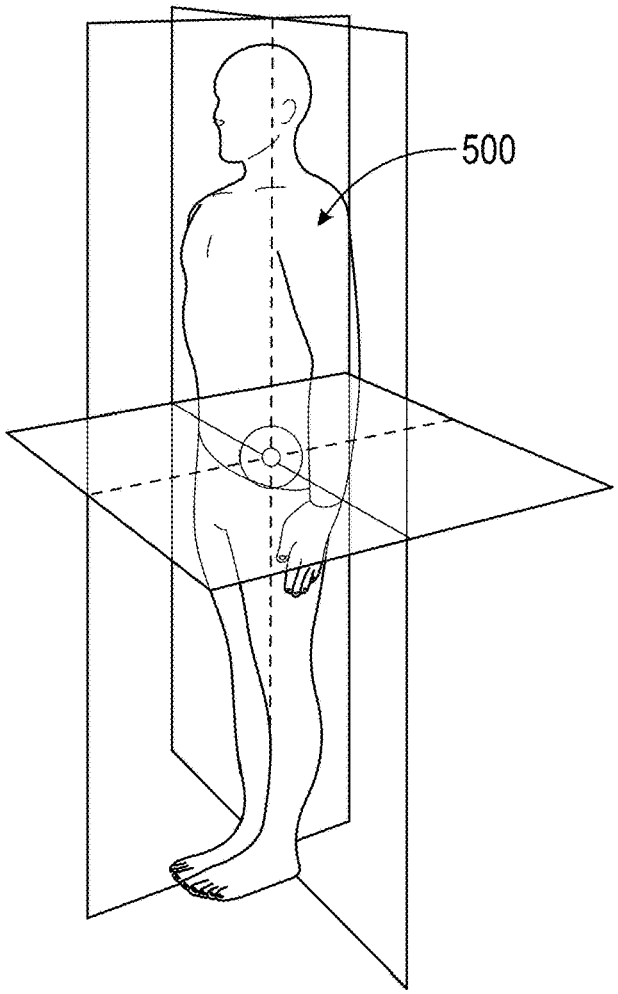
FIG. 12 illustrates a schematic diagram of the belt system anatomical aspect in which certain aspects of the present disclosure may be implemented.
Figure 13:
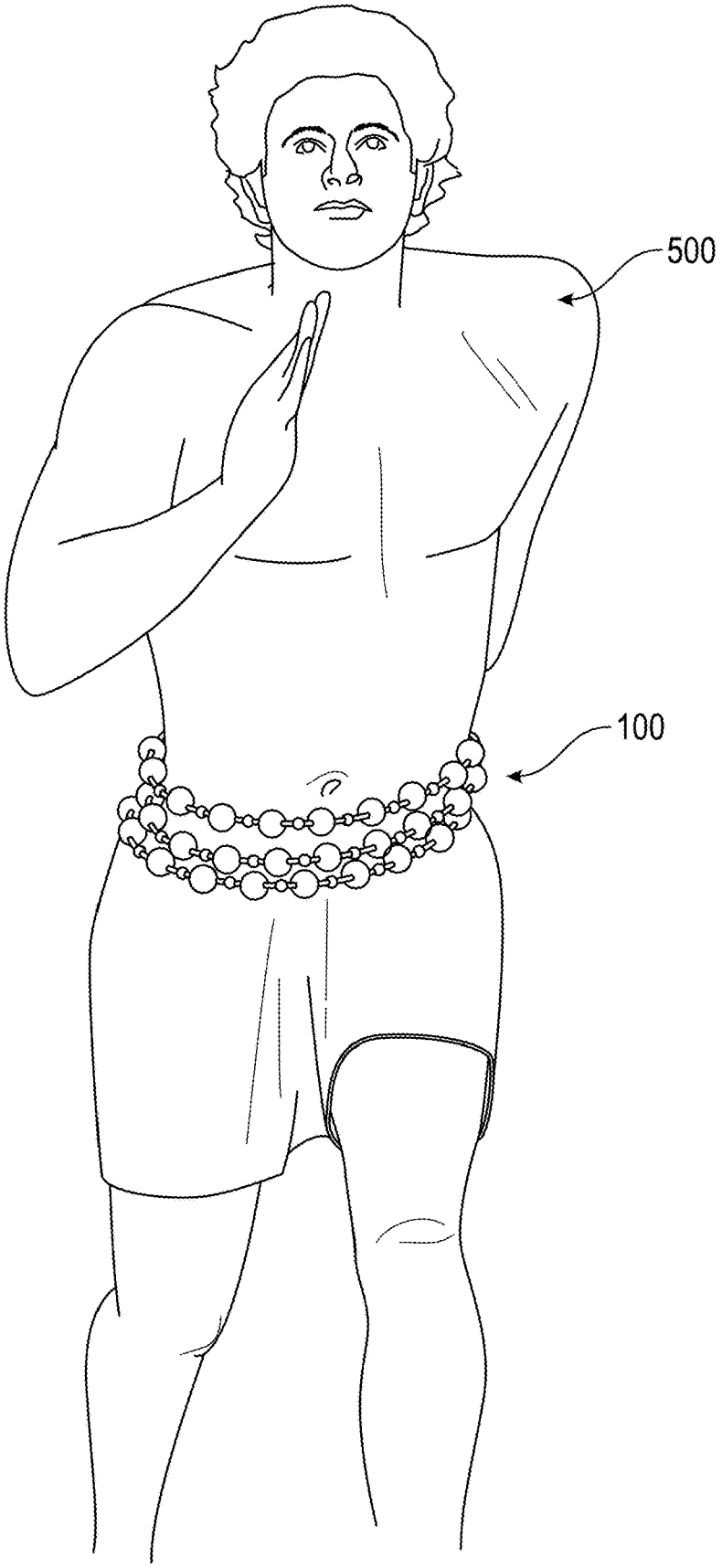
FIG. 13 illustrates a schematic diagram of the weight belt system in-use in which certain aspects of the present disclosure may be implemented.

Referring to FIGS. 7A-B and 8, the weight belt system 100 provides an interlaced stacking arrangement of larger diameter weight sphere 202 and smaller weight sphere 204 when the wrapped around the torso of the wearer 500. It can be seen in FIGS. 7A and 8 that the belt 100 is in three rows 702, 704, 706 around the waist in which the top row 702 is stacked on the middle row 704 and the middle row 704 is stacked on the bottom row 706. Focusing of the top row 702, sphere 202 generally fits between gap between the middle row 706 formed between sphere 202 and sphere 204. That is, the top row 702 sphere 202 can sit on sphere 204 of the middle row 704. Turning to the middle row 706, sphere 202 generally fits between gap between the bottom row 706 formed between sphere 202 and sphere 204. In other words, the middle row 704 sphere 202 can sit on sphere 204 of the bottom row 704. This arrangement improves the fit of the belt system 100 around waist of the wearer 500 during dynamic body movements and explosive body movements and flows with the body. In particular, this arrangement prevents excessive shift of the belt system 100 once wrapped around the waist of the wearer 500.

Referring to. FIGS. 8-10, 11-12, and 13-14, the weight belt system 100 generally sits at the waist of the wearer 500 around the center of gravity of the human body. The belt system 100 has a training effect of the lower torso and upper leg muscles denoted in FIGS. 9 and 10. For example, in the front of the body shown in FIG. 9, the Rectus Femoris, Gracilis and Adductor Longus muscles receive the momentum developed from the weight belt system 100 during dynamic movement, such as running or cutting movements (see FIGS. 13-14). Additionally, the Tensor Fasciae Latae can receive a strengthening and stretching effect during cutting movements. In another example, in the rear of the body behind the frontal plane showing in FIG. 10, the Gluteus Medius, and Gluteus Maximus muscles may receive the momentum developed from the weight belt system 100 during dynamic movement. Additionally, the Biceps Femoris and Semimembranosus muscles can receive a training effect and muscle force intensity from the weight belt system 100. In the disclosed weight belt system 100, a reduction in the level and accumulation of visceral adipose tissue (visceral fat) of a wearer 500 may be enhanced with diet and exercise.

Figure 4:
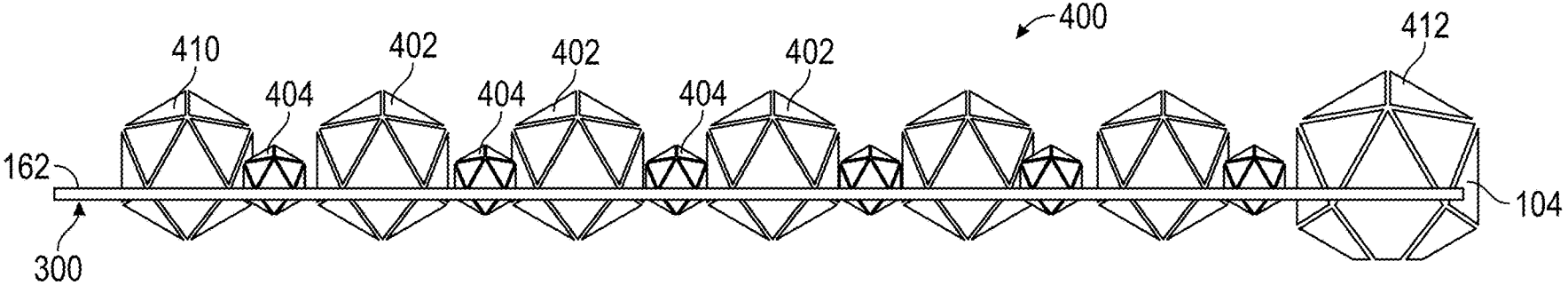
FIG. 4 illustrates a schematic diagram of an alternative weight belt system in which certain aspects of the present disclosure may be implemented.
Figure 5:
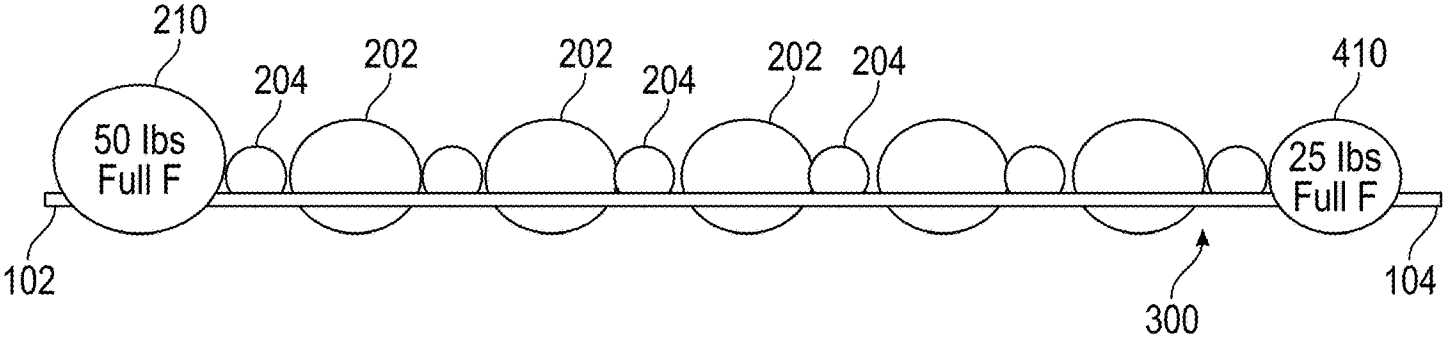
FIG. 5 illustrates a schematic diagram of the weight belt system in which certain aspects of the present disclosure may be implemented.
Figure 6:
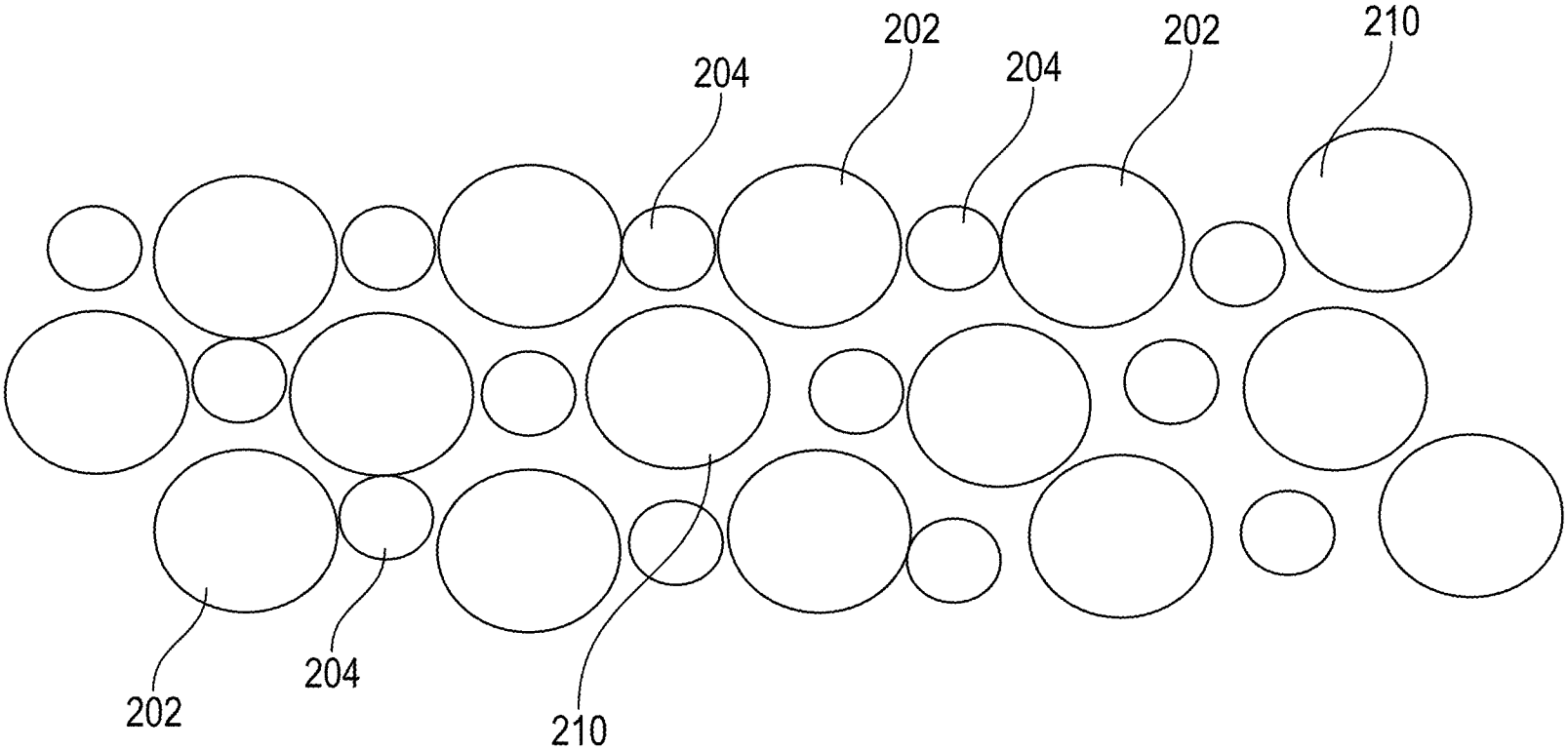
FIG. 6 illustrates a schematic diagram of the weight belt system in which certain aspects of the present disclosure may be implemented.

In an alternative construction shown in FIG. 4, a weight belt system 400 works similarly as system 100 and may include a plurality of interconnected weighted faceted members 200 suspended on a wire member 300 between a first distal free end 102 and a second distal free end 104. In one construction, the faceted spheres 400 may be disposed adjacent to each other with alternating weight sphere 402 and weight sphere 404. In one construction, the first distal free end 102 and the second distal free end 104 may each comprise a magnetic weighted sphere construction 410, 412 to provide fastening or locking functionality to the belt system 400. The faceted configuration of system 400 can provide a tight interlocking stacked arrangement around the torso of the wearer.

Figure 18:
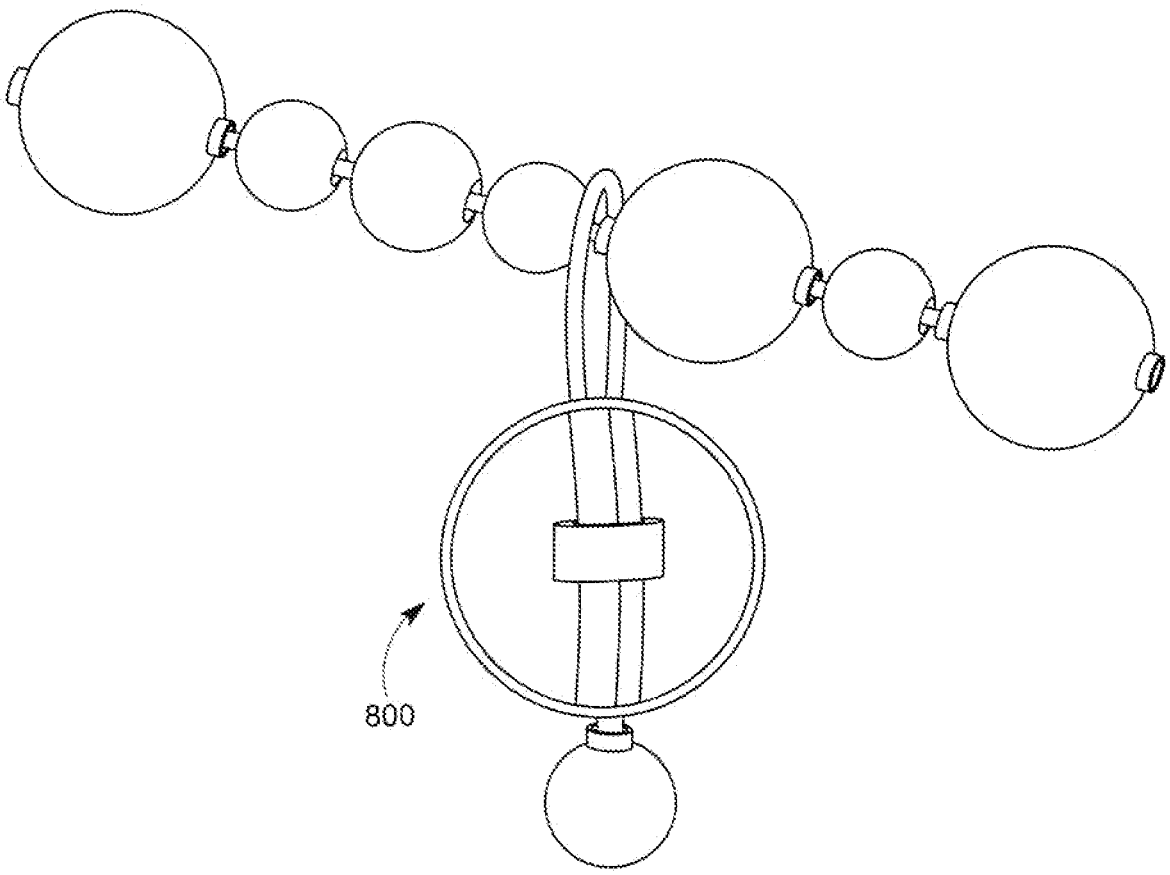
FIG. 18 illustrates a schematic diagram of the weight belt system in-use with an alternative locking system in which certain aspects of the present disclosure may be implemented.
Figure 19:
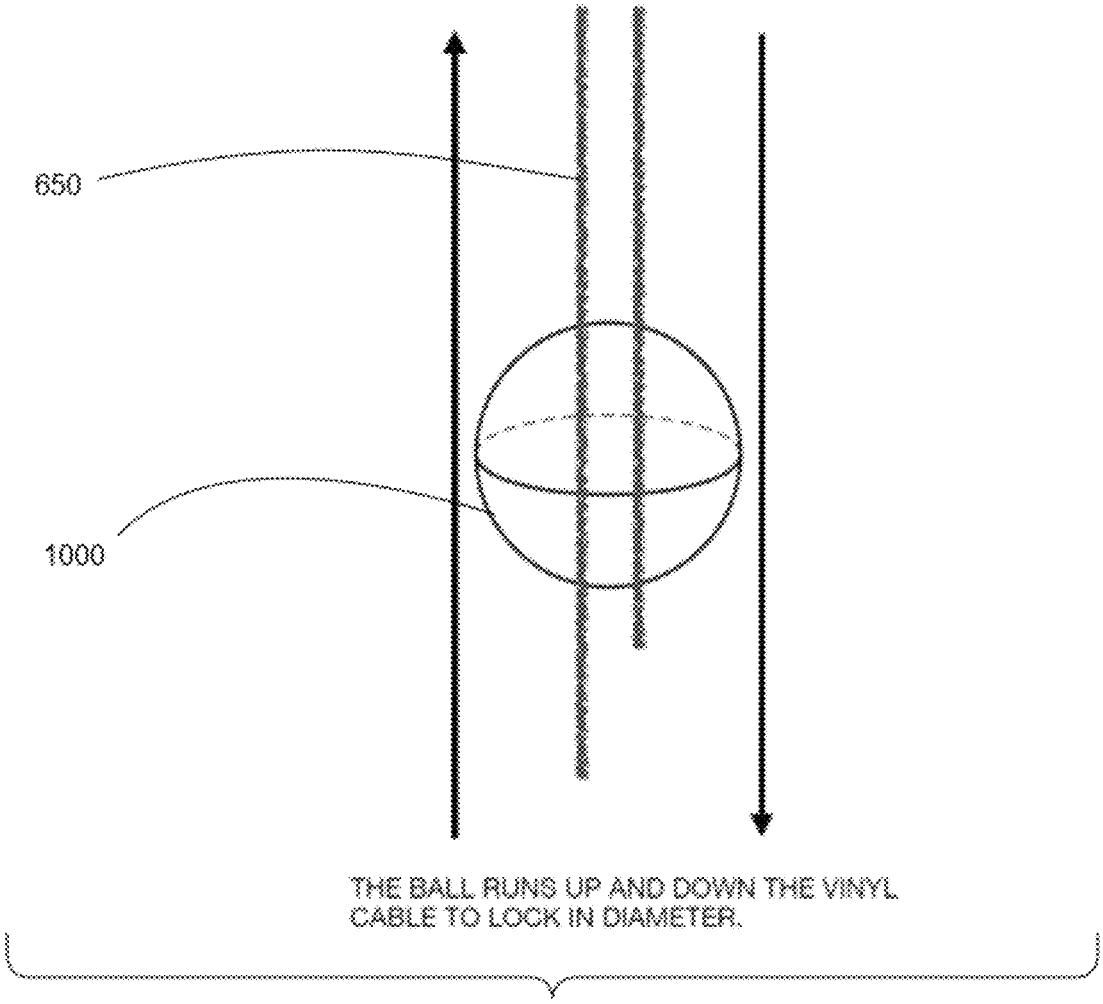
FIG. 19 illustrates a schematic diagram of the weight belt system in-use with an alternative locking system with a slidable ball in which certain aspects of the present disclosure may be implemented.
Figure 20:
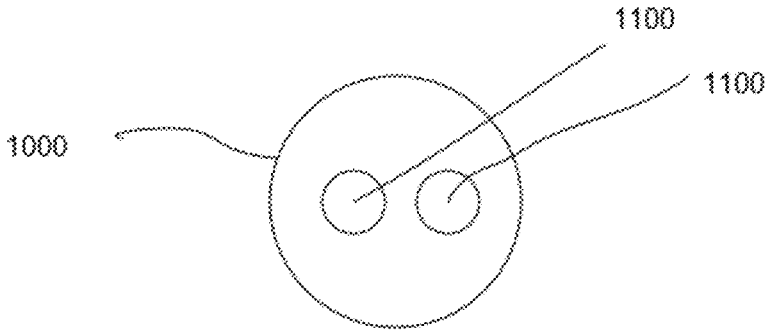
FIG. 20 illustrates a schematic cross-section diagram of the slidable ball of FIG. 19 in which certain aspects of the present disclosure may be implemented.

In the alternative construction shown in FIG. 18, the weight belt system includes a slidable tubular component 800 with slides along loop wire 650. In one implementation, the tubular component 800 moves towards the loop to tighten loop wire 650 for locking belt system in place. In the alternative construction shown in FIG. 19, the weight belt system includes a slidable ball 1000 with slides along loop wire 650. In one implementation, the ball 1000 moves towards the loop to tighten loop wire 650 for locking belt system in place. FIG. 20 shows a cross-section of the ball 1000 with two thru-holes 1100 in which the loop wire 650 extends through to enable slidable movement of the ball 1100.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A weight system being configured for wear to extend around a torso of a human body, comprising:

a first free end and an opposed second free end;

a plurality of interconnected weighted elements being suspended on a wire member extending between the first free end and the second free end, the weighted elements being disposed adjacent to each other with alternating weighted elements; and the first free end and the free second end each including a magnetic weighted element;

wherein the weighted magnetic elements further comprise magnetic spheres; and wherein the magnetic spheres further comprise a first sphere and a second sphere each having different magnetic strengths from each other.

2. The system according to claim 1, wherein the weighted elements further comprises spheres.

3. The system according to claim 2, wherein the spheres further comprise a 316 steel material.

4. The system according to claim 1, further comprising a clasp lock.

5. The system according to claim 1, wherein the wire member further comprises a steel material.

6. The system according to claim 1, wherein a ratio of a magnetic strength of the first sphere to the second sphere is greater than 1.0.

7. The system according to claim 6, wherein the ratio of the magnetic strength is 2.0.

8. A weight system being configured for wear to extend around a torso of a human body, comprising:

a first free end and an opposed second free end;

a plurality of interconnected weighted spheres being suspended on a line member extending between the first free end and the second free end, the weighted spheres being disposed adjacent to each other with alternating weighted elements of a different diameter; and the first free end and the free second end each including a magnetic weighted sphere; wherein the weighted magnetic spheres further comprise a first sphere and a second sphere each having different magnetic strengths from each other.

9. The system according to claim 8, further comprising a clasp lock.

10. The system according to claim 8, wherein a ratio of a magnetic strength of the first sphere to the second sphere is greater than 1.0.

11. The system according to claim 10, wherein the ratio of the magnetic strength is 2.0.

12. The system according to claim 8, wherein the line member further comprises a steel material.

13. The system according to claim 8, further comprising a slidable locking component on the line member.

* * * * *